US010619470B2

(12) United States Patent
Garcia et al.

(10) Patent No.: US 10,619,470 B2
(45) Date of Patent: Apr. 14, 2020

(54) HIGH-PRESSURE JETTING AND DATA COMMUNICATION DURING SUBTERRANEAN PERFORATION OPERATIONS

(71) Applicant: Halliburton Energy Services, Inc., Houston, TX (US)

(72) Inventors: Alexis Garcia, Houston, TX (US); Ahmed Hamdy El-Beltagy, Giza (EG)

(73) Assignee: Halliburton Energy Services, Inc., Houston, TX (US)

( * ) Notice: Subject to any disclaimer, the term of this patent is extended or adjusted under 35 U.S.C. 154(b) by 61 days.

(21) Appl. No.: 15/773,286

(22) PCT Filed: Jan. 13, 2016

(86) PCT No.: PCT/US2016/013212
§ 371 (c)(1),
(2) Date: May 3, 2018

(87) PCT Pub. No.: WO2017/123217
PCT Pub. Date: Jul. 20, 2017

(65) Prior Publication Data

US 2018/0320497 A1 Nov. 8, 2018

(51) Int. Cl.
*E21B 43/26* (2006.01)
*E21B 47/12* (2012.01)
(Continued)

(52) U.S. Cl.
CPC ..... *E21B 43/26* (2013.01); *E21B 43/114* (2013.01); *E21B 44/00* (2013.01); *E21B 47/00* (2013.01); *E21B 47/123* (2013.01)

(58) Field of Classification Search
CPC ..... E21B 43/114; E21B 43/26
See application file for complete search history.

(56) References Cited

U.S. PATENT DOCUMENTS 2,315,496 A * 4/1943 Boynton ..... E21B 43/114 175/67
5,765,642 A * 6/1998 Surjaatmadja ..... E21B 43/114 166/177.5

(Continued)

FOREIGN PATENT DOCUMENTS

CA 2747042 A1 * 1/2012 ..... E21B 21/103

OTHER PUBLICATIONS

International Search Report and The Written Opinion of the International Search Authority, or the Declaration, dated Sep. 12, 2016, PCT/US2016/013212, 15 pages, ISA/KR.

*Primary Examiner* — Jennifer H Gay
(74) *Attorney, Agent, or Firm* — Haynes and Boone, LLP

(57) ABSTRACT

Hydrajetting assemblies provide data communication and the ability to jet abrasive fluid at pumping rates exceeding the abrasiveness rating of downhole devices. A hydrajetting tool includes jetting nozzles to jet a fluid into a subterranean formation. A capillary to house a data communication line is positioned along the housing of the tool. The communication line in run through the capillary and couples to a downflow sensing device having a fluid flow prevention device thereon. During perforating, the fluid flow device is closed, thus causing the pressurized abrasive fluid to jet out the nozzles. Since the sensing device is positioned downflow of the hydrajetting tool, the abrasive fluid may be pumped at a rate exceeding the abrasiveness rating of the sensing device. Also, real-time data may be communicated from the sensing device using the communication line.

18 Claims, 3 Drawing Sheets

(51) Int. Cl.

| | |
|---|---|
| ***E21B 47/00*** | (2012.01) |
| ***E21B 43/114*** | (2006.01) |
| ***E21B 44/00*** | (2006.01) |

(56) References Cited

U.S. PATENT DOCUMENTS 5,771,984 A * 6/1998 Potter ..... E21B 7/14 175/14
6,662,874 B2 * 12/2003 Surjaatmadja ..... E21B 43/267 166/308.6
6,719,054 B2 * 4/2004 Cheng ..... C09K 8/74 166/308.2
6,725,933 B2 * 4/2004 Middaugh ..... E21B 43/26 166/307
7,337,844 B2 * 3/2008 Surjaatmadja ..... E21B 43/26 166/308.1
7,506,689 B2 * 3/2009 Surjaatmadja ..... C09K 8/68 166/280.2
7,775,285 B2 * 8/2010 Surjaatmadja ..... E21B 34/14 166/222
8,261,834 B2 * 9/2012 Eslinger ..... E21B 43/26 166/101
8,757,262 B2 * 6/2014 Dotson ..... E21B 43/114 166/255.2
8,960,292 B2 * 2/2015 Smith ..... E21B 34/14 166/308.1
9,416,636 B2 * 8/2016 Myhre ..... E21B 29/06
10,415,343 B2 * 9/2019 Powers ..... E21B 23/00
2003/0062162 A1 * 4/2003 Middaugh ..... E21B 43/26 166/300
2003/0062166 A1 * 4/2003 Cheng ..... C09K 8/74 166/307
2003/0062167 A1 * 4/2003 Surjaatmadja ..... E21B 43/267 166/308.6
2003/0198562 A1 * 10/2003 Blauch ..... E21B 17/206 417/423.3
2003/0234106 A1 * 12/2003 Surjaatmadja ..... C09K 8/74 166/308.1
2005/0269099 A1 * 12/2005 Stegent ..... E21B 7/18 166/308.1
2006/0070740 A1 * 4/2006 Surjaatmadja ..... E21B 43/114 166/308.1
2006/0185848 A1 * 8/2006 Surjaatmadja ..... C09K 8/68 166/280.2
2006/0201674 A1 * 9/2006 Soliman ..... E21B 36/001 166/298
2007/0215345 A1 * 9/2007 Lafferty ..... E21B 43/26 166/250.1
2007/0261852 A1 * 11/2007 Surjaatmadja ..... E21B 43/26 166/298
2007/0284106 A1 * 12/2007 Kalman ..... E21B 34/02 166/298
2008/0156496 A1 * 7/2008 East ..... E21B 33/1208 166/313
2008/0210427 A1 * 9/2008 Ziauddin ..... E21B 43/26 166/307
2008/0264640 A1 * 10/2008 Eslinger ..... E21B 43/128 166/308.1
2010/0044041 A1 * 2/2010 Smith ..... E21B 34/14 166/280.1
2010/0122817 A1 * 5/2010 Surjaatmadja ..... E21B 34/14 166/308.1
2010/0230105 A1 * 9/2010 Vaynshteyn ..... E21B 43/11857 166/297
2010/0236777 A1 * 9/2010 Partouche ..... E21B 17/206 166/254.2
2011/0146989 A1 * 6/2011 Dotson ..... E21B 43/114 166/298
2013/0098043 A1 4/2013 Surjaatmadja
2014/0182849 A1 * 7/2014 Kumbhar ..... E21B 43/25 166/255.1
2015/0233218 A1 * 8/2015 Myhre ..... E21B 29/06 166/281
2016/0024899 A1 * 1/2016 Lynn ..... E21B 23/06 166/305.1
2016/0160595 A1 * 6/2016 Randall ..... E21B 7/061 166/298
2017/0030173 A1 * 2/2017 MacPhail ..... E21B 43/38
2018/0252057 A1 * 9/2018 Dusterhoft ..... E21B 43/26
2018/0320497 A1 * 11/2018 Garcia ..... E21B 43/114
2019/0017329 A1 * 1/2019 Fripp ..... E21B 43/114
2019/0120035 A1 * 4/2019 Livescu ..... E21B 43/26

* cited by examiner

HIGH-PRESSURE JETTING AND DATA COMMUNICATION DURING SUBTERRANEAN PERFORATION OPERATIONS

CROSS-REFERENCE TO RELATED APPLICATION

The present application is a U.S. National Stage patent application of International Patent Application No. PCT/US2016/013212, filed on Jan. 13, 2016, the benefit of which is claimed and the disclosure of which is incorporated herein by reference in its entirety.

FIELD OF THE INVENTION

The present invention relates generally to fracturing and, more specifically, to a high-pressure hydrajetting tool having a data communication capillary therein.

BACKGROUND

Several techniques have evolved for treating a subterranean well formation to stimulate hydrocarbon production. For example, hydraulic fracturing methods have often been used according to which a portion of a formation to be stimulated is isolated using conventional packers, or the like, and a stimulation fluid containing gels, acids, sand slurry, and the like, is pumped through the well bore into the isolated portion of the formation. The pressurized stimulation fluid pushes against the formation at a very high force to establish and extend cracks on the formation.

However, a number of disadvantages are associated with conventional approaches. First, the typical fracture operation requires two downhole trips: the first trip to perform depth correlations, and the second trip to actually perform the perforation and fracture operation. This is very time consuming and costly because a single trip may take 12 hours or more, and rig time can be in the 100,000 USD per day. Second, there is currently no means by which to receive real-time downhole data related to wellbore parameters during the perforation and fracture operation. Third, the pumping rate used in abrasive perforation operations is limited to the pumping rate and sand concentration thresholds of the various workstring components (also referred to herein as their "abrasiveness rating"). If the abrasiveness rating is exceeded in these conventional approaches, the internal parts of the components would erode until the component was no longer operational, thus requiring costly retrieval, replacement and redeployment. To avoid such phenomena, the abrasiveness rating is not exceeded, which means that it takes more time to perform the perforation and fracture operation.

DESCRIPTION OF ILLUSTRATIVE EMBODIMENTS

Illustrative embodiments and related methods of the present invention are described below as they might be employed in a high-pressure hydrajetting tool providing data communication capabilities. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative embodiments of the present disclosure are directed to hydrajetting tools and assemblies providing data communication and the ability to jet abrasive fluid at pumping rates exceeding the abrasiveness rating of downhole devices. In a generalized embodiment, the hydrajetting tool includes one or more jetting nozzles to jet an abrasive fluid into a subterranean formation. A capillary to house a data communication line is positioned axially along the chassis, or housing, of the tool. The data communication line in run through the capillary and used to couple to a downflow component, such as, for example, a sensing device.

In certain embodiments, the hydrajetting tool may be combined with a sensing device to create a hydrajetting assembly. During operation, a fluid flow prevention device below the sensing device is closed, and abrasive fluid is pumped into the hydrajetting tool to thereby generate abrasive perforations in the near wellbore area. Once the perforations are opened, the fracturing treatment can take place. Since the sensing device is positioned downflow (e.g., below) the hydrajetting tool, the abrasive fluid may be pumped at a rate that exceeds the abrasiveness rating of the sensing device. Moreover, downhole parameters acquired by the sensing device may be communicated uphole in real-time using the data communication line. Accordingly, embodiments of the present disclosure allow for faster and less costly fracturing operations.

Figure 1A:
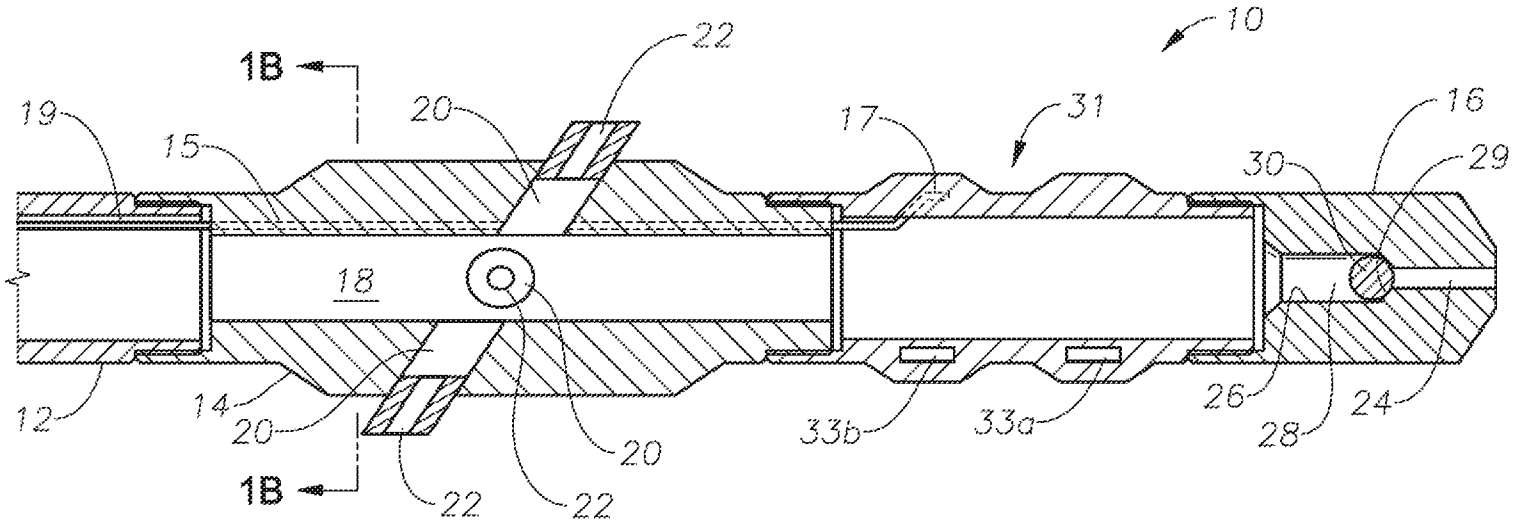
FIG. 1A is a side elevational view of a hydrajetting assembly, according to certain illustrative embodiments of the present disclosure.

Referring now to FIG. 1A, a hydrajetting assembly for use in accordance with the illustrative embodiments of the present disclosure is illustrated and generally designated by the numeral 10. The hydrajetting assembly 10 is shown threadedly connected to a work string 12 through which an abrasive fluid is pumped at a high pressure. In an illustrative embodiment as shown in FIG. 1A the hydrajetting assembly 10 is comprised of a tubular hydrajetting tool 14 coupled to a downflow sensing device 31 having one or more sensors 33*a* and 33*b*. Sensing device 31 is downflow of hydrajetting assembly 10 in that during abrasive perforation operations, the abrasive fluid is pumped through jetting tool 14, then on to sensing device 31. The sensing device may take a variety of forms, including, for example, pressure, temperature, gamma ray, tension, torque, compression, casing collar location, inclination, tool face, or depth correlation sensors.

A fluid flow prevention device 16 is positioned downflow of sensing device 31. Fluid flow prevention device 16 may be selectively opened and closed to allow or prevent fluid flow therethrough. During one illustrative operation, as will be described below, fluid flow prevention device 16 is closed to produce the fluid pressure necessary to jet the abrasive fluid out of hydrajetting tool 14. Fluid flow prevention device 16 may be, for example, a tubular, ball activated, check valve member (as shown). In alternative embodiments, however, a blind nose or other sealing-type device may be used.

A variety of fluids can be utilized in accordance with the embodiments of the present disclosure for forming fractures including, for example, gelled fluids and aqueous fluids. Various additives can also be included in the fluids utilized, such as, for example, abrasives, fracture propping agent, e.g., sand, acid to dissolve formation materials and other additives.

In certain illustrative embodiments, hydrajetting tool 14 includes an axial fluid flow passageway or bore 18 extending therethrough and communicating with at least one and preferably as many as feasible, lateral ports 20 disposed through the sides of the tool 14. A fluid jet forming nozzle 22 is connected within each of the ports 20. As will be described further herein below, fluid jet forming nozzles 22 are preferably disposed in a single plane which is positioned at a predetermined orientation with respect to the longitudinal axis of tool 14. Although an angular orientation is illustrated, such an orientation is not required. In the illustrated embodiment, however, such orientation of the plane of nozzles 22 coincides with the orientation of the plane of maximum principal stress in the formation to be fractured relative to the longitudinal axis of the well bore penetrating the formation.

Figure 1B:
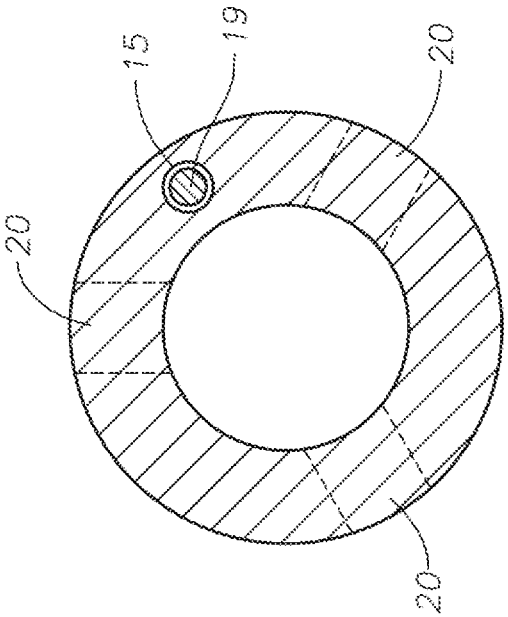
FIG. 1B is a sectional view of the hydrajetting tool along line 1B-1B if FIG. 1A.

FIG. 1B is a cross-sectional view of hydrajetting tool 14 across line 1B-1B of FIG. 1A. With reference to FIGS. 1A and 1B, hydrajetting tool 14 includes a capillary 15 extending through its housing with respect to the longitudinal axis of tool 14. Capillary 15 is a bore of sufficient size to house a data communication cable 19, such as, for example a fiber optic cable or electric cable. Although not shown, cable 19 may extend uphole to the surface or other string components inside workstring 12. In alternative embodiments, data communication cable 19 may also be used to provide power to downhole components. In other illustrative embodiments, data communication cable 19 is made of or coated with an abrasive-resistant material, such as, for example, an alloy material such as Incoloy®.

Capillary 15 may be of any suitable size, such as, for example, 4 mm. Sensing device 31 is coupled to the downflow end of hydrajetting tool 14 using a suitable means. Sensing device 31 also includes a capillary 17 which mates with capillary 15 in order to allow coupling of data communication line 19 with on-board sensors 33*a,b* and associated electronics (e.g., processing circuitry, etc.) (not shown). Although not show, capillaries 15 and 17 would also pass through the crossover, top seat, end connectors, etc.

In this illustrative embodiment, fluid flow prevention device 16 is threadedly connected to the downflow end of sensing device 31 opposite from work string 12 and includes a longitudinal flow passageway 26 extending therethrough. Longitudinal passageway 26 is comprised of a relatively small diameter longitudinal bore 24 through the exterior end portion of device 16 and a larger diameter counter bore 28 through the forward portion of device 16 which forms an annular seating surface 29 in the valve member for receiving a ball 30.

As will be understood by those ordinarily skilled in the art, prior to when ball 30 is dropped into fluid flow prevention device 16 as shown in FIG. 1A, fluid freely flows through hydrajetting tool 14 and device 16. After ball 30 is seated on seat 29 in fluid flow prevention device 16, flow through device 16 is terminated. As a result, all of the abrasive fluid pumped into work string 12 and into hydrajetting tool 14 and sensing device 31 is forced to exit hydrajetting tool 14 by way of fluid jet forming nozzles 22. Since sensing device 31 is positioned downflow of hydrajetting tool 14, the abrasive fluid used to perforate can be pumped at pumping rate higher than the abrasiveness rating of sensing device 31. Moreover, a variety of fluids may be used with varying abrasiveness. In this configuration (once device 16 is closed), the abrasive fluid is not allowed to flow through sensing device 31 and, therefore, the abrasiveness of the fluid does not affect or deteriorate the internal components of sensing device 31. Instead, the abrasive fluid sits inside sensing device 31 during jetting. Moreover, during the pumping of the abrasive fluid, data related to various downhole parameters may be sensed by sensing device 31, processed and communicated uphole via data communication cable 19 in real-time.

When it is desired to reverse circulate fluids through fluid flow prevention device 16, sensing device 31, hydrajetting tool 14 and work string 12, the fluid pressure exerted within work string 12 is reduced whereby higher pressure fluid surrounding hydrajetting tool 14 and device 16 freely flows through device 16, causing ball 30 to be pushed out of engagement with seat 29, up through hydrajetting tool 14, and through work string 12.

Figure 2:
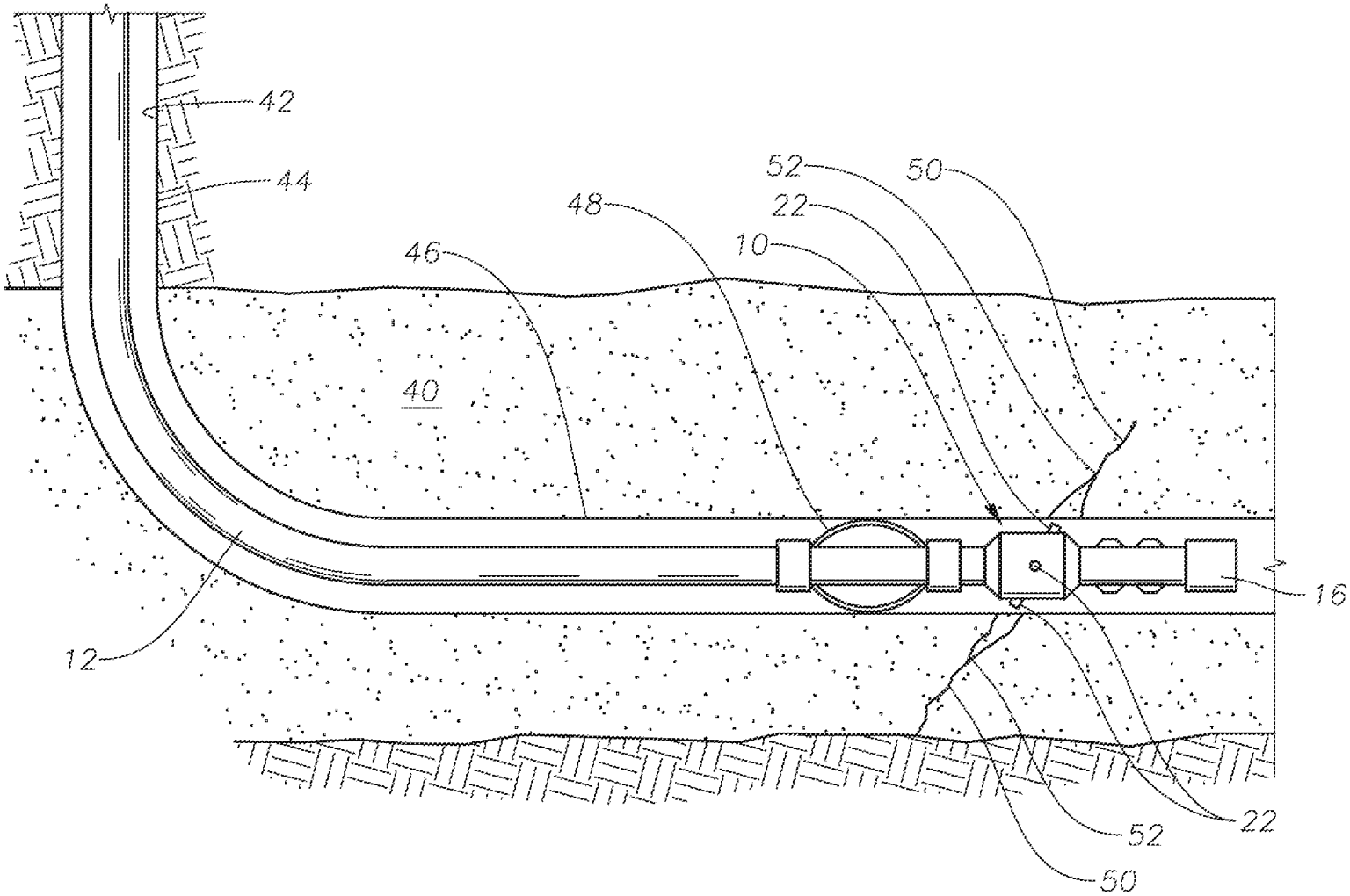
FIG. 2 is a side cross-sectional partial view of a deviated open hole well bore having the hydrajetting assembly of FIG. 1, according to an illustrative application of the present disclosure.

Referring now to FIG. 2, a hydrocarbon producing subterranean formation 40 is illustrated penetrated by a deviated open hole well bore 42. Note, however, that the illustrative embodiments described herein may also be used to perforate cased wellbores. Nevertheless, deviated well bore 42 includes a substantially vertical portion 44 which extends to the surface, and a substantially horizontal portion 46 which extends into formation 40. Work string 12 having the tool assembly 10 and an optional conventional centralizer 48 attached thereto is shown disposed in well bore 42.

In certain illustrative methods, prior to running hydrajetting assembly 10, centralizer 48 and work string 12 into well bore 42, the orientation of the plane of maximum principal stress in formation 40 to be fractured with respect to the longitudinal direction of well bore 42 is determined utilizing various methods, as will be understood by those ordinarily skilled in the art having the benefit of this disclosure. Thereafter, the hydrajetting tool 14 to be used to perform fractures in formation 42 is selected having the fluid jet forming nozzles 22 disposed in a plane which is oriented with respect to the longitudinal axis of hydrajetting tool 14. The plane is selected such that it aligns with the plane of the maximum principal stress in formation 40 when hydrajetting tool 14 is positioned in well bore 42. When fluid jet forming nozzles 22 are aligned in the plane of the maximum principal stress in formation 40 to be fractured and a fracture is formed therein, a single microfracture extending outwardly from and around well bore 42 in the plane of maximum principal stress is formed. However, when fluid jet forming nozzles 22 of hydrajetting tool 14 are not aligned with the plane of maximum principal stress in formation 40, each fluid jet forms an individual cavity and fracture in formation 42 which in some circumstances may be the preferred approach.

In certain illustrative methods, once hydrajetting assembly 10 has been positioned in well bore 42, an abrasive fluid is pumped through work string 12 and through hydrajetting tool assembly 10, whereby the fluid flows through sensing device 31 and the open fluid flow prevention device 16 and circulates through well bore 42. The circulation is continued for a period of time sufficient to clean out debris, pipe dope and other materials from inside the work string 12 and from the well bore 42.

Figure 3:
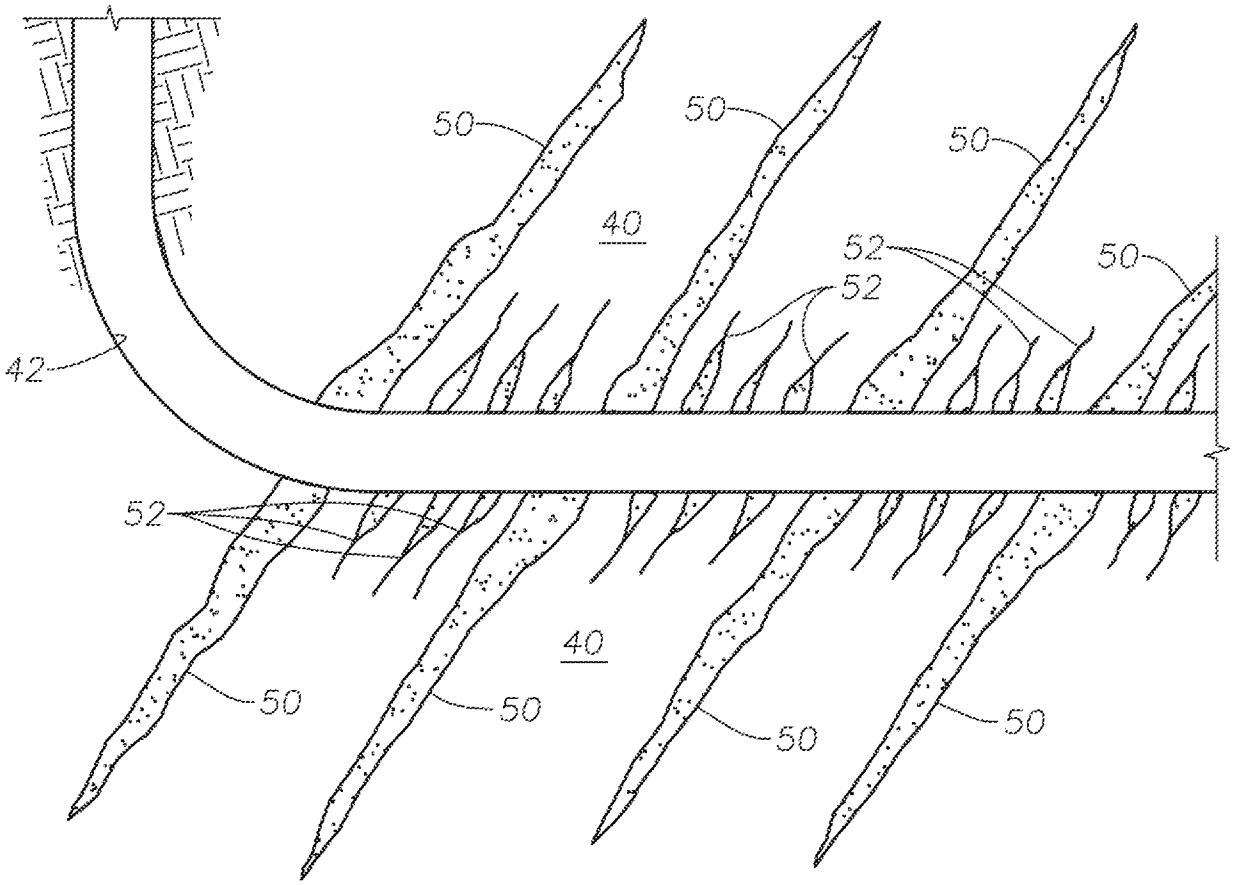
FIG. 3 is a side cross sectional view of the deviated well bore of FIG. 2 after a plurality of microfractures and extended fractures have been created therein, in accordance with certain illustrative methods of the present disclosure.

Thereafter, ball 30 is dropped through work string 12, through hydrajetting tool 14 and sensing device 31, and into device 16, while continuously pumping fluid through work string 12 and hydrajetting assembly 10. When ball 30 seats on annular seating surface 29 in device 16 of assembly 10, all of the fluid is forced through fluid jet forming nozzles 22 of hydrajetting tool 14. The rate of pumping the fluid into work string 12 and through hydrajetting tool 14 is increased to a level whereby the pressure of the fluid which is jetted through nozzles 22 reaches that jetting pressure sufficient to cause the creation of cavities 50 and microfractures 52 in the subterranean formation 40 as illustrated in FIG. 3. Thereafter, hydrajetting assembly 10 may be moved to different positions along formation 40 and the fracture process repeated.

Moreover, since sensing device 31 is positioned downflow of hydrajetting tool 14, the pumping rate may be increased such that it exceeds the abrasiveness rating of sensing device 14. For example, if sensing device 31 can only tolerate a certain sand (or other abrasive material) concentration and pumping rate of abrasive fluid under 3 barrels per minute ("bpm") (i.e., its abrasiveness rating), the illustrative embodiments described herein would allow pumping rates of that abrasive material concentration beyond 3 bpm to be used, thereby providing a faster, more efficient perforation operation.

Also, during pumping or at any other desired time, sensing device 31 may be used to acquire various downhole parameters, as previously described. In certain methods, the sensing device includes a depth correlation sensor whereby the desired depth is precisely determined at which the perforations are made. Although not shown, sensing device 31 may include on-board processing circuitry to acquire and process the depth measurements. In other embodiments, the depth measurements may be processed by remote processing circuitry communicably coupled via data communications line 19. Nevertheless, once the depth measurement is acquired, it may be transmitted uphole in real-time via data communications line 19, thereby providing real-time data for further operations. Moreover, such a method would remove the need for a preliminary depth correlation trip, retrieval, then deployment of the fracturing assembly—as in conventional approaches.

Moreover, although not shown, hydrajetting assembly 10 are communicably coupled to remote processing circuitry via data communication line 19. The processing units may include at least one processor, a non-transitory, computer-readable storage, transceiver/network communication module, optional I/O devices, and an optional display (e.g., user interface), all interconnected via a system bus. The network communication module may be any type of communication interface such as a fiber optic interface and may communicate using a number of different communication protocols. Software instructions executable by the processor for processing the downhole parameters and/or performing other downhole operations described herein may be stored in suitable storage or some other computer-readable medium.

Moreover, those skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Moreover, note that the hydrajetting tool described herein is illustrative in nature. Certain principles of the present disclosure, namely the data communication line capillary and the downflow sensing device, may be utilized in any variety of hydrajetting tools and abrasive perforation methods. Also, the hydrajetting assembly may be deployed along a variety of workstrings including, for example, coiled tubing or a drillstring. Moreover, multiple hydrajetting tools and other downhole and/or downflow devices may form part of the hydrajetting assemblies described herein, without departing from the scope of the present disclosure.

Embodiments and methods of the present disclosure described herein further relate to any one or more of the following paragraphs:

1. A method for fracturing a subterranean formation penetrated by a wellbore, the method comprising positioning a hydrajetting assembly in the wellbore adjacent the formation to be fractured, the hydrajetting assembly comprising: a hydrajetting tool having at least one fluid nozzle; and a sensing device; and jetting abrasive fluid through the nozzle and against the formation at a pumping rate that exceeds an abrasiveness rating of the sensing device, thereby fracturing the formation.

2. A method as defined in paragraph 1, wherein jetting the abrasive fluid comprises communicating the abrasive fluid through the jetting tool first and, thereafter, to the sensing device.

3. A method as defined in paragraphs 1 or 2, further comprising positioning the sensing device downflow of the hydrajetting tool.

4. A method as defined in any of paragraphs 1-3, further comprising using the sensing device to acquiring downhole parameters while the formation is being fractured.

5. A method as defined in any of paragraphs 1-4, further comprising communicating data via a data communication line positioned inside the jetting tool.

6. A method as defined in any of paragraphs 1-5, further comprising communicating a downhole parameter over the communication line, the downhole parameter being sensed by the sensing device.

7. A method as defined in any of paragraphs 1-6, there the communication line is provided as a fiber optic or electrical cable.

8. A method as defined in any of paragraphs 1-7, wherein during jetting, a fluid flow prevention device positioned at a lower end of the sensing device is closed; and after jetting, the fluid flow prevention device is opened if required by the fracturing operation.

9. A hydrajetting assembly for fracturing a subterranean formation penetrated by a wellbore, the assembly comprising a hydrajetting tool having at least one fluid nozzle to jet an abrasive fluid into the formation; and a sensing device positioned downflow of the hydrajetting tool.

10. An assembly as defined in paragraph 9, wherein the hydrajetting tool is configured to jet the abrasive fluid at a pumping rate that exceeds an abrasiveness rating of the sensing device.

11. An assembly as defined in paragraphs 9 or 10, further comprising a data communication line extending through the hydrajetting tool and coupled to the sensing device.

12. As assembly as defined in any of paragraphs 9-11, wherein the communication line is positioned inside a capillary axially extending along a housing of the hydrajetting tool.

13. An assembly as defined in any of paragraphs 9-12, wherein the communication line is a fiber optic or electrical cable.

14. An assembly as defined in any of paragraphs 9-13 further comprising a fluid flow prevention device positioned at a lower end of the sensing device.

15. An assembly as defined in any of paragraphs 9-14, wherein the sensing device is a depth correlation device.

16. An assembly as defined in any of paragraphs 9-15, wherein the sensing device is at least one of a pressure, temperature, gamma ray, tension, compression, inclination, tool face, or torque sensor.

17. A hydrajetting tool for fracturing a subterranean formation penetrated by a wellbore, the tool comprising a housing having an axial bore extending therethrough; at least one fluid nozzle positioned along the housing to jet an abrasive fluid into the formation; and a capillary axially extending along the housing to house a data communication line.

18. A hydrajetting tool as defined in paragraph 17, wherein the communication line is a fiber optic or electrical cable.

19. A hydrajetting tool as defined in paragraphs 17 or 18, wherein the communication line is coupled to a sensing device positioned downflow of the hydrajetting tool.

20. A hydrajetting tool as defined in any of paragraphs 17-19, wherein the hydrajetting tool is configured to jet the abrasive fluid at a pumping rate that exceeds an abrasiveness rating of the sensing device.

Although various embodiments and methods have been shown and described, the invention is not limited to such embodiments and methods and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A method for fracturing a subterranean formation penetrated by a wellbore, the method comprising:

positioning a hydrajetting assembly in the wellbore adjacent the formation to be fractured, the hydrajetting assembly comprising:

a hydrajetting tool having at least one fluid nozzle; and a sensing device; and jetting abrasive fluid through the nozzle and against the formation at a pumping rate that exceeds an abrasiveness rating of the sensing device, thereby fracturing the formation.

2. A method as defined in claim 1, wherein jetting the abrasive fluid comprises communicating the abrasive fluid through the jetting tool first and, thereafter, to the sensing device.

3. A method as defined in claim 1, further comprising positioning the sensing device downflow of the hydrajetting tool.

4. A method as defined in claim 1, further comprising using the sensing device to acquiring downhole parameters while the formation is being fractured.

5. A method as defined in claim 1, further comprising communicating data via a data communication line positioned inside the jetting tool.

6. A method as defined in claim 5, further comprising communicating a downhole parameter over the communication line, the downhole parameter being sensed by the sensing device.

7. A method as defined in claim 5, there the communication line is provided as a fiber optic or electrical cable.

8. A method as defined in claim 1, wherein:

during jetting, a fluid flow prevention device positioned at a lower end of the sensing device is closed; and after jetting, the fluid flow prevention device is opened.

9. A hydrajetting assembly for fracturing a subterranean formation penetrated by a wellbore, the assembly comprising:

a hydrajetting tool having at least one fluid nozzle to jet an abrasive fluid into the formation; and a sensing device positioned downflow of the hydrajetting tool;

wherein the hydrajetting tool is configured to jet the abrasive fluid at a pumping rate that exceeds an abrasiveness rating of the sensing device.

10. An assembly as defined in claim 9, further comprising a data communication line extending through the hydrajetting tool and coupled to the sensing device.

11. As assembly as defined in claim 10, wherein the communication line is positioned inside a capillary axially extending along a housing of the hydrajetting tool.

12. An assembly as defined in claim 10, wherein the communication line is a fiber optic or electrical cable.

13. An assembly as defined in claim 9, further comprising a fluid flow prevention device positioned at a lower end of the sensing device.

14. An assembly as defined in claim 9, wherein the sensing device is a depth correlation device.

15. An assembly as defined in claim 9, wherein the sensing device is at least one of a pressure, temperature, gamma ray, tension, compression, inclination, tool face, or torque sensor.

16. A hydrajetting tool for fracturing a subterranean formation penetrated by a wellbore, the tool comprising:

a housing having an axial bore extending therethrough;

at least one fluid nozzle positioned along the housing to jet an abrasive fluid into the formation; and a capillary axially extending along the housing to house a data communication line;

wherein the hydrajetting tool is configured to jet the abrasive fluid at a pumping rate that exceeds an abrasiveness rating of the sensing device.

17. A hydrajetting tool as defined in claim 16, wherein the communication line is a fiber optic or electrical cable.

18. A hydrajetting tool as defined in claim 16, wherein the communication line is coupled to a sensing device positioned downflow of the hydrajetting tool.

* * * * *